US005747429A

United States Patent [19]

Katoh et al.

[11] Patent Number: 5,747,429

[45] Date of Patent: May 5, 1998

[54] FLUID COMPOSITION FOR USE IN FLUID COUPLINGS CONTAINING AT LEAST ONE FERROCENE DERIVATIVE

[75] Inventors: Tomohiro Katoh; Hitoshi Oenoki; Hironari Ueda; Mikirou Arai; Toshiaki Kuribayashi, all of Saitama-ken, Japan

[73] Assignee: Tonen Corporation, Tokyo, Japan

[21] Appl. No.: 579,342

[22] Filed: Dec. 27, 1995

[30] Foreign Application Priority Data

Dec. 27, 1994 [JP] Japan ..... 6-339960

[51] Int. Cl.[6] ..... C10M 139/06

[52] U.S. Cl. ..... 508/208; 508/209; 508/210; 508/215; 508/384

[58] Field of Search ..... 508/208, 384, 508/210, 209, 215

[56] References Cited

U.S. PATENT DOCUMENTS

| | | | |
|---|---|---|---|
| 2,763,613 | 9/1956 | Scott et al. | 508/384 |
| 2,763,617 | 9/1956 | Scott et al. | 508/384 |
| 2,979,482 | 4/1961 | Piccoli . | |
| 3,745,129 | 7/1973 | Brown, Jr. . | |
| 4,959,166 | 9/1990 | Minamitani et al. | 508/215 |
| 5,332,515 | 7/1994 | Tomizawa et al. | 508/210 |
| 5,334,319 | 8/1994 | Tomizawa et al. | 508/215 |
| 5,334,320 | 8/1994 | Tomizawa et al. | 508/215 |
| 5,366,646 | 11/1994 | Sato et al. | 508/262 |

FOREIGN PATENT DOCUMENTS

| | | |
|---|---|---|
| 0 462 777 | 12/1991 | European Pat. Off. . |
| 1 186 850 | 9/1959 | France . |
| 58-126897 | 7/1983 | Japan . |
| 1 088 352 | 10/1967 | United Kingdom . |

OTHER PUBLICATIONS

77–59893, Database WPI, Jul. 1977, Section Ch, Week 7734, Derwent Publications Ltd., London, Great Britain (Abstract).

90–121455, Database WPI, March 1990, Section Ch, Week 9016, Derwent Publications, Ltd. London, Great Britain (Abstract).

92–295465, Database WPI, Jul. 1992, Section Ch. Week 9236, Derwent Publications Ltd., London, Great Britain (Abstract).

*Primary Examiner*—Jerry D. Johnson
*Attorney, Agent, or Firm*—Young & Thompson

[57] ABSTRACT

A fluid composition for use in fluid couplings has the superior anti-gelling properties of an organopolysiloxane base oil, is low in changes in viscosity and changes in torque, is stable and has extremely high durability, and is especially useful because of its viscosity as a fluid for "fan" couplings. The fluid composition according to the invention is provided, by adding at least one type of ferrocene derivative, in a weight ratio wherein the atomic iron content is 10 ppm to 5,000 ppm, selected from the group consisting of the compounds represented by the general formula (1) and the general formula (2) for an organopolysiloxane base oil having a viscosity of 50 $mm^2/s$ to 20,000 $mm^2/s$ at 25° C. The compounds of general formula (1) may be represented by the following formula:

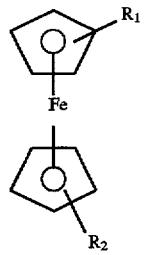

(1)

wherein $R_1$ and $R_2$ are identical or different, and are each independently selected from the group consisting of $C_{2-25}$ alkyl, alkenyl, cyclo-alkyl, and cyclo-alkenyl. Additionally, one of $R_1$ and $R_2$ can be hydrogen atom. The compounds of general Formula (2) may be represented by the following formula:

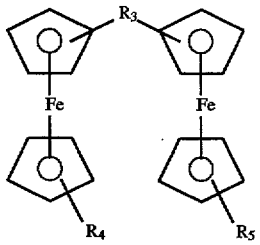

(2)

wherein $R_3$ is a bivalent $C_{2-25}$ hydrocarbon group; and $R_4$ and $R_5$ are each independently selected from the group consisting of $C_{2-25}$ alkyl, alkenyl, cycloalkyl, and cyclo-alkenyl.

10 Claims, No Drawings

FLUID COMPOSITION FOR USE IN FLUID COUPLINGS CONTAINING AT LEAST ONE FERROCENE DERIVATIVE

FIELD OF THE INVENTION

The present invention relates to fluid compositions used in fluid couplings for power transmission. More particularly, the compositions of the present invention are superior in terms of durability, and provide suitable fluid compositions for a fluid coupling, especially as a viscous fluid for a fan coupling.

BACKGROUND OF THE INVENTION

Fluid transmission are means in which mechanical power is converted to fluid power, and the transmission of power is carried out by converting it again to mechanical power. The fluid coupling is one type of a fluid transmission. There are various types of fluid coupling structures and functions, such as a "viscous" coupling or a fan coupling. For example, the fan coupling is used for cooling a car radiator.

The fan coupling (fan clutch) is attached to the end of a shaft, and the groove on the disk surface on the shaft side and the groove on the wheel surface on the fan side are interlocked. In the interlocked state, it is structured by forming a so-called labyrinth between the two. The disk on the shaft side rotates while being soaked in a viscous fluid for the transmission of torque in the body. When the disk is rotated in accordance with the rotation of the shaft, the rotation power is transmitted to the wheel side due to the characteristics of the viscous fluid, and the fan is rotated. The fan coupling does not increase the rotation speed of the fan used for cooling the radiator above a designated value, therefore, it is possible to put a limit on the maximum rotation speed.

In general, organopolysiloxane (i.e. silicone oil) is used as the viscous fluid. In actuality, dimethylpolysiloxane (dimethylsilicone oil) or methylphenylpolysiloxane (methylphenylsilicone oil), and a mixture of the above are used as the organopolysiloxane. These organopolysiloxanes have superior thermal resistance and anti-oxidability in comparison to other base oils, and their temperature-viscosity characteristics are also good across a wide range, and they have a superior viscosity index.

The organopolysiloxanes have superior characteristics as a working fluid in a fluid coupling; however, due to the heat caused by the severe shearing and friction created between each of the components at the time of the high speed rotational transmission of torque when they are used for an extended period of time, deterioration such as gelling takes place, and they lose the torque transmission function. This is one shortcoming. In addition, the viscosity stability is also lost during the process of gelling. As described above, the organopolysiloxanes have low stability at high temperatures, and it is therefore difficult to maintain a stable torque transmission function for a long period of time under severe conditions of use.

Conventionally, as countermeasures for the above, it has been proposed to add various types of additives, such as an anti-oxidant or an anti-wear agent to the organopolysiloxane. It is known that among these additives, an organic transition metal compound such as ferrocene or iron octoate and the like are effective as thermal stabilizers.

For example, in the specification of U.S. Pat. No. 2,979,482, it is proposed to add ferrocene or a ferrocene derivative, in order to increase the thermal stability of the organopolysiloxane. Methyl, phenyl, carboxyl, propionyl, chrolopropionyl, carboxybenzoyl and the like are shown as substituents of the ferrocene derivatives.

In Japanese Unexamined Patent Application Sho 58-126897, it is proposed to add a ferrosiloxane compound comprising the product of reacting iron carboxylate, nitrogen and di-substituted silylamine, as a thermal stabilizer for di-organopolysiloxane.

However, it is clear that a fluid composition in which an organic transition metal compound such as ferrocene or a ferrocene derivative, proposed conventionally, has been added to the organopolysiloxane as a thermal stabilizer, is not sufficiently effective to prevent the gelling and improvement in terms of durability is small when it is used as a viscous fluid for fluid couplings, especially for fan couplings.

In addition, in many cases, phenolic antioxidant or amine antioxidant is also added in practice. However, the thermal stabilization effect is not sufficient using only these antioxidants.

SUMMARY OF THE INVENTION

A principal object of the present invention is to provide a fluid composition for a fluid coupling, which has the superior anti-gelling properties of an organopolysiloxane base oil, is low in terms of changes in viscosity and changes in torque, is stable and has extremely high durability.

A more particular object of the present invention is to provide a fluid composition for a fluid coupling, especially used as the viscous fluid for a fan coupling.

The present inventors conducted extensive research in order to overcome the problematic points observed in the conventional technology, and as a result, discovered that when ferrocene derivatives containing a specific organic substituent are added to the organopolysiloxane base oil, it is possible to obtain a fluid composition in which the gel prevention property is improved greatly under severe conditions. When this fluid composition is used as the viscous fluid for a fan coupling, the durability is improved surprisingly, in comparison to that of conventional products. This invention was thus completed on the basis of this knowledge.

In the manner described above, according to the present invention, a fluid composition for a fluid coupling is provided, by adding at least one type of ferrocene derivative, in a weight ratio wherein the atomic iron content is 10 ppm to 5,000 ppm, selected from the groups consisting of the compounds represented by the general formula (1) and the general formula (2) for an organopolysiloxane base oil having a viscosity of 50 $mm^2/s$ to 20,000 $mm^2/s$ at 25° C.

The compounds of general formula (1) may be represented by the following formula:

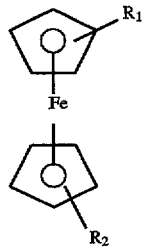

(1)

wherein $R_1$ and $R_2$ are identical or different, and are each independently selected from the group consisting of $C_{2-25}$ alkyl, alkenyl, cyclo-alkyl, and cyclo-alkenyl. Additionally, one of $R_1$ and $R_2$ can be a hydrogen atom.

The compounds of general formula (2) may be represented by the following formula:

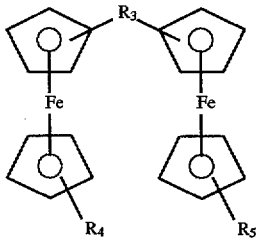

(2)

wherein $R_3$ is a bivalent $C_{2-25}$ hydrocarbon group; and $R_4$ and $R_5$ are each independently selected from the group consisting of $C_{2-25}$ alkyl, alkenyl, cyclo-alkyl, cyclo-alkenyl, and hydrogen atom.

DETAILED DESCRIPTION OF PREFERRED EMBODIMENTS

The fluid composition for a fluid coupling according to the present invention is prepared by including at least one type of ferrocene derivative, in a weight ratio wherein the iron atom content is 10 ppm to 5,000 ppm. The ferrocene derivatives are selected from the group consisting of compounds represented by the general formula (1) and the general formula (2) for an organopolysiloxane base oil having a viscosity of 50 $mm^2/s$ to 20,000 $min^2/s$ at 25° C.

The compounds of general formula (1) may be represented by the following formula:

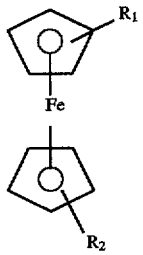

(1)

wherein $R_1$ and $R_2$ are identical or different, and are each independently selected from the group consisting of $C_{2-25}$ alkyl, alkenyl, cyclo-alkyl, and cyclo-alkenyl. Additionally, one of $R_1$ and $R_2$ can be hydrogen atom.

The compounds of general formula (2) may be represented by the following formula:

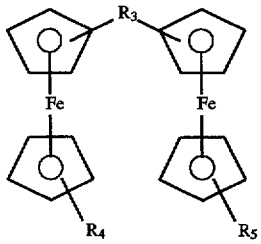

(2)

wherein $R_3$ is a bivalent $C_{2-25}$ hydrocarbon group; and $R_4$ and $R_5$ are each independently selected from the group consisting of $C_{2-25}$ alkyl, alkenyl, cyclo-alkyl, and cyclo-alkenyl.

The present invention will now be explained in detail by the following.

Base Oil

The base oil used in this invention is organopolysiloxane (silicon oil) in which the kinematic viscosity measured at 25° C. is 50 $mm^2/s$–20,000 $mm^2/s$ (cSt), preferably 100 $mm^2/s$–10,000 $mm^2/s$, and even more preferably 500 $mm^2/s$–5,000 $mm^2/s$. The polymer represented by the following general formula (3) is representative of such organopolysiloxanes:

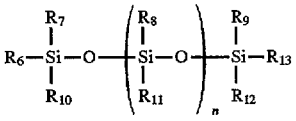

(3)

wherein $R_6$ through $R_{13}$ are identical or different, and represent a $C_{1-18}$ hydrocarbon group. This hydrocarbon group can be substituted with a halogen atom if it is so desired. The letter n in the above formula represents the number of unit monomers.

Specific examples of hydrocarbon groups $R_6$ through $R_{13}$ are as follows: an alkyl group such as methyl, ethyl, n-propyl, isopropyl, n-butyl, isobutyl, t-butyl, n-pentyl, neopentyl, hexyl, heptyl, octyl, decyl, undecyl, dodecyl, tridecyl, tetradecyl, pentadecyl, hexadecyl, heptadecyl and octadecyl; an aryl group such as phenyl and naphthyl; an aralkyl group such as benzyl, 1-phenylethyl, and 2-phenylethyl; a diaryl group such as o-diphenyl, m-diphenyl, and p-diphenyl; and a halohydrocarbon group such as o-chlorophenyl, m-chlorophenyl, p-chlorophenyl, o-bromophenyl, m-bromophenyl, p-bromophenyl, 3,3,3-trifluoropropyl, 1,1,1,3,3,3-hexfluoro-2-propyl, heptafluoroisopropyl, and heptafluoro-n-propyl.

Especially preferred examples of $R_6$ through $R_{13}$ include the fluorohydrocarbon groups having 1 to 8 carbon atoms excluding unsaturated aliphatic hydrocarbon groups methyl and phenyl. Examples of the preferred organopolysiloxanes include dimethylpolysiloxane (dimethyl silicon oil), methylphenylpolysiloxane (methylphenyl silicon oil), dimethylmethylphenylpolysiloxane, dimethyldiphenylpolysiloxane, methylhexylpolysiloxane, methyloctylpolysiloxane, methyltrifluoropropylpolysiloxane, dimethylmethyltrifluoropropylpolysiloxane, methylhydrogenpolysiloxane (methylhydrogen silicon oil), difluoroalkylpolysiloxane (fluorosilicon oil), and mixture of two or more of the above.

If a base oil whose viscosity is less than approximately 50 $mm^2/s$ at 25° C., is used as the viscous fluid for a fluid coupling, especially as the viscous fluid for a fan coupling, it is not possible to obtain sufficient torque. On the other hand, if the viscosity of the base oil is too high, in some cases, the torque suddenly increases during use.

Ferrocene Derivatives

In the present invention, a specific ferrocene derivative, represented by the general formulae (1) and (2) described previously, is used as an organopolysiloxane thermal stabilizer. It has been confirmed from X-ray structural analyses that ferrocene {bis-(cyclopentadienyl) iron (II)} is a compound which forms layered structures.

The ferrocene derivatives represented by the general formula (1) described previously have a specific substituent on one side or on both sides of the cyclopentadienyl ring of ferrocene. In other words, in the general formula (1), $R_1$ and $R_2$ can be identical to each other or different, comprising a hydrocarbon group having 2 to 25 carbon atoms. At the same time, one of these can be a hydrogen atom.

According to the present invention, the ferrocene derivative represented by the following general formula (1A) is especially preferred. In the general formula (1A), $R_{11}$ and $R_{22}$, are selected from the group consisting of $C_{2-25}$ alkyl, alkenyl, cycloalkyl and cycloalkenyl, and at the same time, one of the them can be hydrogen atom.

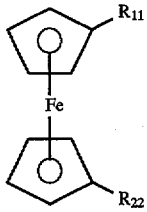

(1A)

Examples of the alkyl group can be ethyl, n-propyl, isopropyl, n-butyl, isobutyl, t-butyl, n-pentyl, neopentyl, hexyl, heptyl, octyl, decyl, and octadecyl. Examples of the alkenyl group can be vinyl, aryl and the like. Examples of the cycloalkyl group can be, for example, cyclopentyl, cyclohexyl, cyclooctyl and the like. Examples of the cycloalkenyl group can be, for example, cyclopentenyl, cyclohexenyl, cyclooctenyl and the like.

Preferred examples of the ferrocene derivatives represented by the general formula (1) can be ethylferrocene [(η-cyclopentadienyl)(η-ethylcyclopentadienyl) iron (II)], n-butylferrocene [(η-cyclopentadienyl)(η-n-butylcyclopentadienyl) iron (II)], vinylferrocene [(η-cyclopentadienyl)(η-vinylcyclopentadienyl) iron (II) ], cyclohexylferrocene [(η-cyclopentadienyl)(η-cyclohexylcyclopenta dienyl)iron (II)], cyclohexenylferrocene [(η-cyclopentadienyl)(η-cyclohexenylcyclopentadienyl) iron (II)] and the like.

If ferrocene as disclosed in U.S. Pat. No. 2,979,482specification, or methyl ferrocene, ferrocene carboxylic acid and the like is used as a thermal stabilizer, organopolysiloxane is added, and is used as the viscous fluid for the fan coupling, it is not possible to obtain the superior fluid composition.

The ferrocene derivatives represented by the general formula (2) described previously and used for the present invention, provide for two ferrocene moieties to be connected by a divalent hydrocarbon group, and at the sane time, at least one of these two ferrocene moieties can be a compound having a specific substituent. In other words, in the general formula (2), $R_3$ is the divalent hydrocarbon group having 2 to 25 carbon atom. $R_4$ and $R_5$ can be identical, or can be different, and they are selected from the group consisting of hydrogen atom and $C_{2-25}$ hydrocarbon groups.

The ferrocene derivatives represented by the following formula (2A) are especially preferred for use in the present invention. In the general formula (2A), $R_{33}$ is the divalent hydrocarbon group having 2–25 carbon atoms. $R_4$ and $R_{55}$ are $C_{2-25}$ hydrocarbon groups, and can be selected from the group consisting of alkyl, alkenyl, cycloalkyl and hydrogenatom.

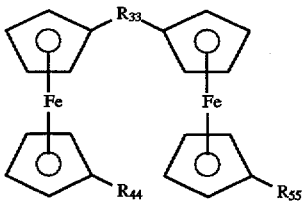

(2A)

A preferred example, of the divalent hydrocarbon group is an alkylene group such as ethylene, trimethylene, and propylene. Examples of the alkyl, alkenyl, cycloalkyl and cycloalkenyl groups can be the same as indicated for the general formula (1).

Specific examples of the ferrocene derivatives represented by the general formula (2) can be bis(ethylferrocenyl) propane, bis(n-butylferrocenyl)propane, bis(cyclohiexenyl) propane, and the like.

These ferrocene derivatives can be used singly or can be combined in mixtures of two or more. The combining ratio of the ferrocene derivatives is such that atomic iron is present in an amount of 10 ppm to 5,000 ppm by weight, preferably 30 ppm to 1,000, and more preferably 50 ppm to 500 ppm, based on the organopolysiloxane base oil. The iron atom content can be measured using atom absorption spectrometry.

If the content of the ferrocene derivatives is too small, the effect of improvement in durability is small. If too much is added, the effect is saturated and it is not so economical.

Other Additives

In addition to the mandatory inclusion of the above-described ferrocene derivatives, it is possible to add various other types of additives such as an anti-oxidant, an antiwear additive, a corrosion inhibitor, or a metal deactivator and the like. Among the above various types of additives, when it is used with the ferrocene derivatives, some of them show a synergistic effect in improvement, in regard to the viscosity stability, torque stability, anti-gel property,thermal stability and the like of the fluid composition.

The examples of these various types of additives include the following compounds.

(1) It is desirable to add an antioxidant to the fluid composition according to the present invention, in order to maintain the stability when the fluid composition is used under severe conditions.

Examples of the antioxidant include: for example, amine compounds such as diphenylamine, p,p'-dibutyldiphenylamine, p,p'-dipentyldiphenylamine, p,p'-dihexyldiphenylamine, p,p'-diheptyldiphenylamine, p,p'-dioctyldiphenylamine, p,p'-dinonyldiphenylamine, monooctyldiphenylamine, monononyldiphenylne, tetrabutyldiphenyl-amine, tetrahexyldiphenylamine, tetraoctyldiphenylamine, tetranonyldiphenylamine, $C_{4-9}$alkydiphenylamine, phenyl-alpha-naphthylamine, phenyl-beta-naphthylamine, butylphenyl-alpha-naphthylamine, butylphenyl-beta-naphthylamine, pentylphenyl-alpha-naphthylamine, pentylphenyl-beta-naphthylamine, hexylphenyl-alpha-naphthylamine, hexylphenyl-beta-naphthylamine, heptylphenyl-alpha-naphthylamine, heptylphenyl-beta-naphthylamine, octylphenyl-alpha-naphthylamine, nonylphenyl-beta-naphthylamine, N-nitroso-diphenylamine, phenothiazine, N,N'-dinaphthyl-p-phenylenediamine, acridine, N-methylphenothiazine, N-ethyl-phenothiazine, dipyridylamine, phenolamine and the like; phenol compounds such as 2,6-di-t-butyl-alpha methylamino-para-cresol, 2,6di-t-butylphenol, 2,6-di-t-butyl-para-cresol, 2,6-di-t-butyl-4-ethylphenol, 2,4-dimethyl-6-t-butylphenol, 4,4'-isopropyliden-bis(2,6-di-t-butyl-phenol), 4,4'-thiobis(2-methyl-6-t-butylphenol), 4,4'-thiobis(3-methyl-6-t-butylphenol), 4,4'-methylene-bis(2,6-di-t-butylphenol) and the like; organic iron salt groups such as iron octanoate, ferrocene, iron naphthanoate and the like; organic cerium salt such as cerium naphthanoate, cerium toluate, and the like; organic metal compound complexes including an organic zirconium salt such as zirconiumoctanoate and the like; and a mixture of two or more of the substituents described above.

If the ferrocene derivative and an antioxidant are used, the anti-gelling property, viscosity stability and the torque stability of the fluid composition are further improved. Among the antioxidants, the amine-based antioxidant is desirable, among the above, the diphanylamine -based antioxidant is especially preferred.

An antioxidant can be used in a ratio of 0.01 weight percent to 10 weight percent in a normal situation and desirably 0.05 weight percent to 3 weight percent, in the total weight of the component. If the content is too small, the effect by addition is too small, and on the other hand, if the content is too much, it is not economical and also the quality of mass property may be reduced.

(2) Additives to improve the durability, which are the compounds known as the corrosion inhibitors, are, for example, benzotriazole, imidazolidine, pyrimidine, isostearate, n-octadecylammonium stearate, duomine Tdiorate, lead naphthenate, sorbitan oleate, pentaerythritol oleate, oleyl-sarcosine, alkylsuccinic acid, alkenylsuccinic acid, and mixtures of these derivatives.

The content of these corrosion inhibitors, in the total weight standard of the component, normally, is 0.01 weight percent to 1 weight percent, and desirably 0.01 weight percent to 0.5 weight percent. If the content is less than 0.01 weight percent, the effect of the addition is small, and on the other hand, if it is too much, that is, adding more than 1 weight percent, the quantity of precipitation is increased.

(3) Additives to improve the durability, which are the compounds known as antiwear additives, are, thiophosphoric acid ester,bis this phosphoric acid ester group, and bis-dithiophosphoric acid ester, can be added.

The content of these compounds, in the total weight of the component, normally, is 0.01 weight percent to 5 weight percent, and more desirably, 0.1 weight percent to 3 weight percent.

(4) Phosphorous-based antiwear additives can comprise the following compounds. For example, phosphate ester such as benzyldiphenylphosphate, aryldiphenylphosphate, triphenylphosphate, tricresylphosphate, ethyldiphenylphosphate, tributylphosphate, cresyldiphenylphosphate, dicresylphenylphosphate, ethylphenyldiphenylphosphate, diethylphenylphenylphosphate, pyropylphenyldiphenylphosphate, dipropyl-phenylphenylphosphate, triethylphenyl phosphate, tripropylphenyl phosphate, butylphenyldiphenyl phosphate, dibutylphenylphenyl phosphate, tributylphenyl phosphate, propylphenylphenyl phosphate mixture, butylphenylphenyl phosphate mixture and the like; and the acid phosphate ester such as the lauryl acid phosphate, stearyl acid phospate, di-2ethylhexylphosphate and the like, can be added.

It is possible to use a compound in which the phosphate is replaced by the thiophosphate, in the phosphate and acid phosphate described above.

In addition, it is also possible to add a triarylphosphorothionate group such as triphenylphosphorothionate and the like, or a alkyl-diaryl-phosphorothionate group. It is also possible to use a compound such as phosphorothionate that is substituted by the thiophosphorothionate.

Furthermore, it is possible to mix the phosphite ester such as tri-isopropyl phosphite, triphenyl phosphite, tricresyl phosphite, tris(nonylphenyl) phosphite, tri-iso-octyl phosphite, diphenylisodecyl phosphite, phenyldi-isodecyl phosphite, tri-isodecyl phosphite, tristearyl phosphite, trioleyl phosphite and the like; and acid phosphite ester such as di-isopropylhydrogen phosphite, di-2-ethylhexylhydrogen phosphite, dilaurylhydrogen phosphite, di-oleylhydrogen phosphite and the like.

In addition, it is also possible to use a substituted compound such as thiolauryl thiophosphite in which phosphite is replaced by thiophosphite, in the phosphite ester or acid phosphite ester described above.

These phosphate compounds can be used as an abrasion prevention agent in general, however, when this is used with the compound containing phosphoric atom, the effects on the viscous stability in the polyorganosiloxane, torque stability and the prevention of gelling are further increased.

Among these phosphoric compounds, especially, the compounds containing the structure of the triaryl phosphate and triaryl phosphorotionate are desirable in view of the heat stability effect.

The other compounds known as the phosphorous-based antiwear additive, can be used, for example, di-n-butylhexyl phosphonate, n-butyl-n-dioctyl phosphonate, hexamethylphosphoric triamide, di-butylphosphoro amidate and the like.

The content of these phosphorous-based compound, based on the total weight of the composition, is normally 0.01 weight percent to 5 weight percent, preferably, 0.1 weight percent to 3 weight percent, and more preferably, 0.1 weight percent to 1 weight percent.

(5) It is possible to use the carbamate compound such as methylene-bis (dibutylditluocarbamate) and the like known as an anti-wear agent.

The content of these compounds, by total weight of the composition, is normally 0.01 weight percent to 5 weight percent, and desirably 0.1 weight percent to 3 weight percent.

(6) It is also possible to use compounds known as anti-wear additives, for example, the thiadiazol derivatives such as 2,5-dimercapto-1,3,4-thiadiazol, 2-mercapto-5-methylmercapto-1,3,4-thiadiazol, di(5-mercapto-1,3,4-thiadiazol-2-ir) disulphide, 2,5-bis(n-octyl-dithio)-1,3,4-thiadiazol, 2-amino-5-mercapto-1,3,4-thiadiazol, and their derivatives (for example, alkyl derivatives in which the mercapto group is processed with alkylation); and thiazole derivatives such as 2-mercapto-4-methyl-5-(2'-hydroxyethyl) thiazole, 2-mercapt-o-benzothiazole, and their derivatives (for example , alkyl derivatives in which the mercapto group is processed with alkylation).

These compounds are normally mixed in the ratio of 0.01 weight percent to 3 weight percent in the total weight of the component.

The various types of additives described above can be added to the polyorganosiloxane base oil by itself or in combinations of two or more. By doing the above, it is possible to improve the viscosity stability and the torque stability, in comparison to cases when the compounds containing the sulfur atom described previously. When these various types of additives are used, the viscosity change, torque change, and the gel in the polyorganosiloxane base oil in the fluid composition being used under the high temperature conditions are especially further improved.

Especially, the additives showing large combination effect include (1) amine-based antioxidant, especially di-phenylamine antioxidant, (2) benzotriazole and its derivatives, and (3) phosphorus-based anti-wear agent, for example, phosphite ester or acid phosphite ester.

EXAMPLES

A more detailed explanation concerning this invention is explained hereafter using the Examples and Comparative Examples. However, this present invention is not limited only to these Examples.

The performance of the fluid composition is evaluated using the following method. The experimental material is filled into the fan coupling with the filling rate of 60 volume percent at 25° C. This fan coupling is rotated at 6,300 rpm, and in time the viscosity of the experimental material increases due to the gelling, such that the output rotation is rapidly changed to 1,800 rpm. The operation time (in hours) up to this point is evaluated as a measure of durability.

Examples 1

N-butylferrocene in 200 ppm weight ratio as iron atom (Fe) is added to the dimethylsilicone oil having a viscosity of 2,000 $mm^2/s$ at 25° C., and the fluid composition is prepared. The fluid composition obtained in this manner is used for the performance evaluation. The results are shown in Table 1—1.

Example 2

N-butylferrocene in 200 ppm weight ratio as iron atom (Fe) is added to the dimethylsilicone oil having a viscosity of 2,000 $mm^2/s$ at 25° C., and, furthermore, diphenylamine in 2 weight percent by total weight of the composition is added, and the fluid composition is prepared. The fluid composition being obtained in this manner is used for the performance evaluation. The results are shown in Table 1—1.

Example 3

N-butylferrocene in 200 ppm weight ratio as iron atom (Fe) is added to the dimethylsilicone oil having a viscosity of 2,000 $mm^2/s$ at 25° C., and, furthermore, methylbenzotriazole as a benzotriazole compound was added in an amount of 0.1 weight percent by total weight of the composition, and the fluid composition is prepared. The fluid composition obtained in this manner is used the performance evaluation. The results are shown in Table 1—1.

Example 4

N-butylferrocene in 200 ppm weight ratio as iron atom (Fe) is added to the dimethylsilicone oil having a viscosity of 2,000 $mm^2/s$ at 25° C., and, furthermore, the tris-nonylphenyl phosphite as a phosphite compound was added in an amount of 0.1 weight percent by total weight of the composition, and the fluid composition is prepared. The fluid composition obtained in this manner is used for the performance evaluation. The results are shown in Table 1—1.

Example 5

N-butyl-ferrocene in 200 ppm weight ratio as iron atom (Fe) is added to the dimethylsilicone oil having a viscosity of 2,000 $mm^2/s$ at 25° C., and, furthermore, the diphenylamine in an amount of 2 weight percent and methylbenzotriazole in an amount of 0.1 weight percent by total weight of the composition, and the fluid composition is prepared. The fluid composition obtained in this manner is used for the performance evaluation. The results are shown in Table 1—1.

Example 6

The fluid composition is prepared in the same manner as in the Example 5 except that tris-nonylphenyl phosphate is used in place of the methylbenzotriazole. The results of the performance evaluation are shown in Table 1—1.

Example 7

N-butylferrocene in 200 ppm weight ratio as iron atom (Fe) is added to the dimethylsilicone oil having a viscosity of 2,000 $mm^2/s$ at 25° C., and, furthermore, the diphenylamine is added in an amount of 2 weight percent, benzotriazole compound (methylbenzotriazole) is added in an amount of 0.1 weight percent and phosphite compound (tris-nonylphenylphosphite) is added in an amount of 0.1 weight percent by total weight of the composition, and the fluid composition is prepared. The fluid composition obtained in this manner is used for the performance evaluation. The results of the performance evaluation are shown in Table 1—1.

Comparative Example 1

The ferrocene derivative is not added, and only the dimethylsilicone oil (kinematic viscosity at 25° C. is 2,000 $mm^2/s$) is used as the fluid composition. The results of the performance evaluation are shown in Table 1—1.

Comparative Example 2

The ferrocene derivative is not added to the dimethylsilicone oil whose kinematic viscosity at 25° C. is 2,000 $mm^2/s$, and only the diphenylamine is added in an amount of 0.1 weight percent by total weight of the composition. The results of the performance evaluation are shown in Table 1—1.

Comparative Example 3

The ferrocene derivative is not added to the dimethylsilicone oil whose kinematic viscosity at 25° C. is 2,000 $mm^2/s$, and only the diphenylamine in an amount of 0.1 weight percent, benzotriazole compound (methylbenzotriazole) in an amount of 0.1 weight percent and phosphite compound (tris-nonylphenyl phosphite) in an amount of 0.1 weight percent are added, by total weight of the composition, and the fluid composition is prepared. The results of the performance evaluation are shown in Table 1-2.

Examples 8 and Comparative Examples 4 through 6

A mixed oil of 90% by weight dimethylsilicone oil and 10% by weight phenyl-modified silicone oil (phenyl modification of 25 percent, kinematic viscosity at 25° C. being 3,000 $mm^2/s$) is used as the base oil, the diphenylamine in an amount of 2 weight percent by total weight of the composition is added, and the ferrocene derivative or ferrosiloxane as iron atom (Fe) shown in Table 1 in the weight ratio of 70 ppm, is added, and the fluid composition is prepared. In Table 1, the ferrosiloxane is a reaction mixture of the secondary iron octoate and N,N-dimethyl aminotrimethylsilane, which is described in the Example 1 of the Japanese Unexamined Patent Publication No. Sho 58-126897. The evaluation results concerning the durability hours are shown in Table 1-2.

Examples 9 through 11 and Comparative Examples 7 and 8

Diphenylamine in an amount of 2 weight percent by total weight of the composition is added to the dimethylsilicone oil (kinematic viscosity at 25° C. being 700 $mm^2/s$), and furthermore, the ferrocene derivative shown in Table 1 is added. The —COOH substituted ferrocene derivative in the Table 1—1 is the ferrocenecarboxylic acid described in the Example 2 of the specification of the U.S. Pat. No. 2,979,482. The evaluation results of the performance are shown in Table 1-2, and Table 1-3.

Example 12

Cyclohexenylferrocene as the iron atom (Fe) in the weight ratio of 100 ppm is added to the phenyl-modified silicone oil (kinematic viscosity at 25° C. being 3,000 $mm^2/s$), and furthermore, the diphenylamine in an amount of 2 weight percent is also added, and the fluid composition is prepared. The evaluation results of the performance are shown in Table 1-3.

Example 13

Bis(ethylferrocenyl)propane contributing iron atom (Fe) in the weight ratio of 100 ppm is added to the dimethylsilicone oil (kinematic viscosity at 25° C. being 2,000 $mm^2/s$), and the fluid composition is prepared. The evaluation results of the performance are shown in Table 1-3.

Example 14

A mixed oil (kinematic viscosity at 25° C. being 3,000 $mm^2/s$) of 70% by weight of dimethylsilicone oil (coefficient of kinematic viscosity at 25° C. being 5,000 $mm^2/s$) and 30% by weight dimethylsilicon oil (kinematic viscosity at 25° C. being 100 $mm^2/s$) is used as the base oil, and added thereto are bis (ethylferrocenyl)propane in 80 ppm of weight ratio as the iron atom, diphenylamine in 2 weight percent, phosphite compound (trisnonylphenyl phosphite) in 0.1 weight percent and RHEOMET 39 (product name, manufactured by Nippon Chibagaigi Kabushiki Kaisha) in 0.05 weight percent as an additive of the benzotriazole, by total weight of the composition, and thus the fluid composition is prepared. The evaluation results of the performance are shown in Table 1-3.

Example 15

The fluid composition is prepared in the same manner as in the Example 2 except that the phenyl-alpha-naphthylamine in the same weight amount is used in the place of diphenylamine. The evaluation results of the performance are shown in Table 1-3.

Example 16

The fluid composition is prepared in the same manner as in the Example 7 except that the phenyl-alpha-naphthylamine in the some weight amount is used in the place of diphenylamine. The evaluation results of the performance are shown in Table 1-3.

TABLE 1-1

| | Base oil Vis. ($mm^2/s$ @ 25° C.) | Base oil Composition | Ferrocene compound | Antioxidant | Other Additives | Durability (hour) |
|---|---|---|---|---|---|---|
| Example 1 | 2000 | Dimethylsilicone 100% | n-butylferrocene Fe 200 ppm | — | — | 300 |
| Comp. Example 1 | 2000 | Dimethylsilicone 100% | — | — | — | 25*1 |
| Example 2 | 2000 | Dimethylsilicone 100% | n-butylferrocene Fe 200 ppm | Diphenylamine 2% | — | 370 |
| Comp. Example 2 | 2000 | Dimethylsilicone 100% | — | Diphenylamine 2% | — | 50 |
| Example 3 | 2000 | Dimethylsilicone 100% | n-butylferrocene Fe 200 ppm | — | Benzotriazole compound 0.1% | 330 |
| Example 4 | 2000 | Dimethylsilicone 100% | n-butylferrocene Fe 200 ppm | — | Phosphite compound 0.1% | 320 |
| Example 5 | 2000 | Dimethylsilicone 100% | n-butylferrocene Fe 200 ppm | Diphenylamine 2% | Benzotriazole compound 0.1% | 380 |
| Example 6 | 2000 | Dimethylsilicone 100% | n-butylferrocene Fe 200 ppm | Diphenylamine 2% | Phosphite compound 0.1% | 380 |
| Example 7 | 2000 | Dimethylsilicone 100% | n-butylferrocene Fe 200 ppm | Diphenylamine 2% | Benzotriazole compound 0.1% Phosphite compound 0.1% | 400 |

TABLE 1-2

| | Base oil Vis. ($mm^2/s$ @ 25° C.) | Base oil Composition | Ferrocene compound | Antioxidant | Other Additives | Durability (hour) |
|---|---|---|---|---|---|---|
| Comp. Example 3 | 2000 | Dimethylsilicone 100% | — | Diphenylamine 2% | Benzotriazole compound 0.1% Phosphite compound 0.1% | 70 |
| Example 8 | 3000 | Dimethylsilicone 90% Ph-modified silicone 10% | Bis(ethylferrocenyl) propane Fe 70 ppm | Diphenylamine 2% | — | 380 |
| Comp. Example 4 | 3000 | Dimethylsilicone 90% Ph-modified silicone 10% | ferrocene Fe 70 ppm | Diphenylamine 2% | — | 60 |
| Comp. Example 5 | 3000 | Dimethylsilicone 90% | Ferrosiloxane | Diphenylamine 2% | — | (*1) |

TABLE 1-2-continued

| | Base oil Vis. ($mm^2/s$ @ 25° C.) | Base oil Composition | Ferrocene compound | Antioxidant | Other Additives | Durability (hour) |
|---|---|---|---|---|---|---|
| | | Ph-modified silicone 10% | Fe 70 ppm | | | |
| Comp. Example 6 | 3000 | Dimethylsilicone 90% | Methylferrocene | Diphenylamine 2% | — | 120 |
| | | Ph-modified silicone 10% | Fe 70 ppm | | | |
| Example 9 | 700 | Dimethylsilicone 100% | Cyclohexenyl ferrocene Fe 100 ppm | Diphenylamine 2% | — | 780 |
| Example 10 | 700 | Dimethylsilicone 100% | Cyclohexenyl ferrocene Fe 100 ppm | Diphenylamine 2% | Benzotriazole compound 0.1% | 800 |
| Example 11 | 700 | Dimethylsilicone 100% | Cyclohexenyl ferrocene Fe 100 ppm | Diphenylamine 2% | Benzotriazole compound 0.1% Phosphite compound 0.1% | 830 |

TABLE 1-3

| | Base oil Vis. ($mm^2/s$ @ 25° C.) | Base oil Composition | Ferrocene compound | Antioxidant | Other Additives | Durability (hour) |
|---|---|---|---|---|---|---|
| Comp. Example 7 | 700 | Dimethylsilicone 100% | — | Diphenylamine 2% | Phosphite compound | 120 |
| Comp. Example 8 | 700 | Dimethylsilicone 100% | —COOH substituted ferrocene compound Fe 100 ppm | Diphenylamine 2% | — | (*1) |
| Example 12 | 3000 | Ph-modified silicone 100% | Cyclohexenyl ferrocene Fe 100 ppm | Diphenylamine 2% | — | 1000*3 |
| Example 13 | 2000 | Dimethylsilicone 100% | Bis(ethylferrocenyl) propane Fe 100 ppm | — | — | 450 |
| Example 14 | 3000 | Dimethylsilicone 5,000 $mm^2/s$ 70% 100 $mm^2/s$ 30% | Bis(ethylferrocenyl) propane Fe 80 ppm | Diphenylamine 2% | Benzotriazole compound(*2) 0.05% Phosphite compound 0.1% | 500 |
| Example 15 | 2000 | Dimethylsilicone 100% | n-butylferrocene Fe 200 ppm | Diphenyl-alpha-naphthylamine 2% | — | 390 |
| Example 16 | 2000 | Dimethylsilicone 100% | n-butylferrocene Fe 200 ppm | Diphenyl-alpha-naphthylamine 2% | Benzotriazole compound 0.1% Phosphite compound 0.1% | 430 |

(*1)Experiment was stopped due to an abnormal increase in rpm.

(*2) Rheomet 39 (product name, manufactured by Nippon Chibagaigi Kabushiki Kaisha)

(*3) Experiment was stopped at 1,000 hour.

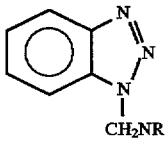

(4)

As clearly seen from the results shown in Tables 1 1—1 through 1-3, the durability is greatly improved, if a ferrocene derivative having a selected substituent is added to the organopolysiloxane base oil (Examples 1 through 6).

On the other hand, the improvement effect in terms of durability is small or the improvement effect is not observed, when ferrocene (Comparative Example 4), methylferrocene (Comparative Example 6) and —COOH substituted ferrocene compounds (Comparative Example 8) are used, even though these are ferrocene compounds. In addition, the improvement effect in the durability is not observed in the case when the ferrosiloxane (Comparative Example 5) is used, even though it is a compound containing iron.

Furthermore, it became clear that when a specific ferrocene derivative and the antioxidant (e.g., diphenylamine), or the antioxidant, and the corrosion inhibitor (e.g., benzotriazole compound) or the anti-wear agent (e.g., phosphite compound) are added (Examples 2, 3 and 6), the improvement effect in the durability is further improved.

Effect of the Present Invention

According to the present invention, it is possible to obtain a fluid composition for a fluid coupling, which has the superior anti-gelling properties of an organopolysiloxane base oil, is low in changes in viscosity and changes in torque, is stable and extremely high in durability. The fluid composition for fluid coupling according to the present invention is especially suitable as a viscous fluid for a fan coupling.

What is claimed is:

1. A fluid composition for use in fluid couplings, comprising an organopolysiloxane base oil having a viscosity of 50 $mm^2/s$ to 20,000 $mm^2/$ s at 25° C., said base oil containing at least one ferrocene derivative in an amount such that iron from said ferrocene is present in said composition in an amount of 10 ppm to 5,000 ppm, said at least one ferrocene derivative being selected from the group consisting of $C_{6-25}$ cycloalkenyl ferrocene, and compounds of general formula (2A)

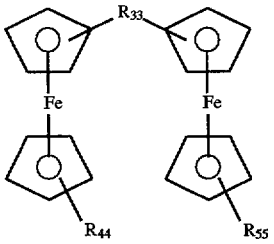

(2A)

wherein $R_{33}$ is a divalent hydrocarbon group having 2–25 carbon atoms and $R_{44}$ and $R_{55}$ are each independently selected from the group consisting of $C_{2-25}$ alkyl, alkenyl, cycloalkyl, cycloalkenyl, and wherein one of $R_{44}$ and $R_{55}$ can be a hydrogen atom.

2. The fluid composition for fluid coupling described in claim 1, wherein said at least one ferrocene derivative is $C_{6-25}$ cycloalkenyl ferrocene.

3. The fluid composition for fluid coupling described in the claim 1, wherein said at least one ferrocene derivative is of the general formula (2A).

4. The fluid composition for fluid coupling described in the claim 1, wherein the fluid composition is prepared by adding said at least one ferrocene derivative to said organopolysiloxane base oil, and further comprising an antioxidant in an amount of 0.01 weight percent to 10 weight percent by total weight of said composition.

5. The fluid composition for fluid coupling described in claim 4, wherein said antioxidant is diphenylamine.

6. The fluid composition for fluid coupling described in the claim 4, wherein said antioxidant is benzotriazole.

7. The fluid composition for fluid coupling described in claim 1, further comprising at least one of (a) an antioxidant and corrosion inhibitor in an amount of 0.01 weight percent to 1 weight percent by total weight of said composition, and (b) an antiwear additive in an amount of 0.01 weight percent to 5 weight percent by weight of said organopolysiloxane base oil.

8. The fluid composition for fluid coupling described in claim 7, wherein said antiwear additive is a phosphite compound.

9. In a fluid transmission apparatus which transmits power by converting mechanical power to fluid power and converting said fluid power back to mechanical power, a method of improving operation of said transmission by operating said transmission while containing a fluid composition comprising an organopolysiloxane base oil having a viscosity of 50 $mm^2/s$ to 20,000 $mm^2/s$ at 25° C., said base oil containing at least one ferrocene derivative in an amount such that iron from said ferrocene is present in said composition in an amount of 10 ppm to 5,000 ppm, said at least one ferrocene derivative being selected from the group consisting of $C_{6-25}$ cycloalkenyl ferrocenes and compounds of general formula (2A)

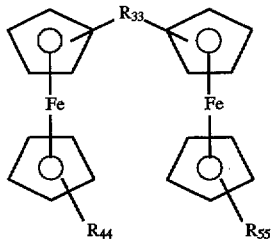

(2A)

wherein $R_{33}$ is a divalent hydrocarbon group having 2–25 carbon atoms; and $R_{44}$ and $R_{55}$ are each independently selected from the group consisting of $C_{2-25}$ alkyl, alkenyl, cycloalkyl and cycloalkenyl, and wherein one of $R_{44}$ and $R_{55}$ can be a hydrogen atom.

10. The method described in the claim 9, wherein said fluid transmission apparatus is a fluid coupling.

* * * * *